US005555997A

United States Patent [19]

Nogles

[11] Patent Number: 5,555,997

[45] Date of Patent: Sep. 17, 1996

[54] PRESSURE COMPENSATING WATER HEATER

[75] Inventor: Thomas G. Nogles, Broomall, Pa.

[73] Assignee: Southcorp Water Heaters USA, Inc., Bala Cynwyd, Pa.

[21] Appl. No.: 538,255

[22] Filed: Oct. 3, 1995

Related U.S. Application Data

[63] Continuation of Ser. No. 195,387, Feb. 14, 1994, abandoned.

[51] Int. Cl.[6] ..... B65D 25/16

[52] U.S. Cl. ..... 220/404; 222/389; 222/183; 219/438; 126/350 R; 220/723; 220/721

[58] Field of Search ..... 222/95, 105, 183, 222/386.5, 389; 126/344, 361, 350 R; 220/403, 404, 720, 721, 723, 461, 468, 421; 392/444, 446, 449–455, 458–460; 219/438–440

[56] References Cited

U.S. PATENT DOCUMENTS

| | | | |
|---|---|---|---|
| 2,273,505 | 2/1942 | Florian . | |
| 2,695,753 | 11/1954 | Kirk, Jr. . | |
| 3,097,766 | 7/1963 | Biehl et al. | 222/95 |
| 3,101,839 | 8/1963 | Holman | 220/403 |
| 3,198,390 | 8/1965 | Beckman et al. | 222/105 |
| 3,240,394 | 3/1966 | Modderno | 222/95 |
| 3,434,660 | 3/1969 | Brumme et al. . | |
| 3,601,128 | 8/1971 | Hakim . | |
| 3,621,882 | 11/1971 | Kuplec . | |
| 3,675,684 | 7/1972 | Mercier et al. . | |
| 3,721,371 | 3/1973 | Dolveck . | |
| 3,722,751 | 3/1973 | Bisciglia . | |
| 3,828,608 | 8/1974 | Yamamoto . | |
| 3,902,624 | 9/1975 | Stephenson . | |
| 3,917,115 | 11/1975 | Travers et al. . | |
| 4,013,221 | 3/1977 | Eder . | |
| 4,077,543 | 3/1978 | Kulikowski et al. | 222/95 |
| 4,098,434 | 7/1978 | Uhlig | 222/95 |
| 4,206,908 | 6/1980 | Mercier . | |
| 4,211,208 | 7/1980 | Lindner . | |
| 4,270,533 | 6/1981 | Andreas | 222/95 |
| 4,340,379 | 7/1982 | Williamson . | |
| 4,658,434 | 4/1987 | Murray . | |
| 4,817,830 | 4/1989 | Yavorsky | 222/386.5 |
| 4,981,112 | 1/1991 | Adams et al. . | |
| 5,110,643 | 5/1992 | Akao et al. . | |
| 5,199,594 | 4/1993 | Obara et al. | 220/403 |
| 5,207,250 | 5/1993 | Tsao . | |
| 5,253,778 | 10/1993 | Sirosh . | |
| 5,332,121 | 7/1994 | Schmidt et al. | 222/386.5 |

*Primary Examiner*—Stephen J. Castellano
*Attorney, Agent, or Firm*—Miller & Christenbury

[57] ABSTRACT

A water heater storage tank including a rigid outer shell having ports connected for water flow into and out from the storage tank. The water heater storage tank also has a flexible container within the outer shell having a wall and fittings connected to the wall for water flow into and out from the container. The fittings on the wall of the container are mounted in the ports on the outer shell. The container has a pressure compensating cushion mounted integrally with the wall of the container. The pressure compensating cushion is inflated to compensate for pressure fluctuations within the water heater storage tank.

8 Claims, 7 Drawing Sheets

PRESSURE COMPENSATING WATER HEATER

This application is a continuation of application Ser. No. 08/195,387, filed Feb. 14, 1994, now abandoned.

BACKGROUND OF THE INVENTION

This invention relates to a water heater having means to compensate for pressure fluctuations within the water heater storage tank. Particularly, this invention relates to a water heater capable of maintaining a substantially constant pressure within the storage tank as water within the storage tank expands or contracts with temperature variations.

FIELD OF THE INVENTION

Temperature variations within closed water storage systems have historically created problems relating to the safety and efficiency of the storage system. When the temperature of a stored medium increases, the medium expands proportionally, thereby causing a pressure increase. Similarly, when the temperature of a stored medium decreases, the medium contracts, thereby decreasing pressure. These pressure fluctuations create safety concerns and could cause a closed tank to burst or collapse. Pressure fluctuations also compromise storage system efficiency by tending to expel a quantity of the stored medium out from, or pull external medium into, the system.

Although water heater systems are provided with means, such as check valves and pressure-rated vessels, for eliminating safety concerns caused by pressure fluctuations, the efficiency issue has yet to be conclusively resolved. For example, when water in a water heater storage tank heats up and expands, a quantity of hot water tends to be forced back through the cold water inlet. This loss of hot water wastes energy and reduces water heater efficiency.

In some instances hot water is prevented from escaping through the cold water inlet by a check valve. In that case, however, the expanded hot water tends instead to be forced out through the temperature-pressure relief valve usually present. This loss of hot water causes significant decrease in efficiency, causing up to or exceeding 3% waste.

Various attempts to eliminate detriments associated with pressure fluctuations have been made without success. For example, U.S. Pat. Nos. 2,273,505, granted Feb. 17, 1942, to Raymond R. Horian; No. 2,695,753, granted Nov. 30, 1954, to Chester H. Kirk; and No. 3,902,624, granted Sep. 2, 1975, to Eben A. Stephenson provide expansible bodies or bags mounted to a vessel wall to compensate for volumetric fluctuations. This structure is disadvantageous in that it requires the creation of an additional port in the vessel wall. The '624 patent even requires the connection of an expansible bag to the external atmosphere or to a source of compressed air.

The following U.S. Pat. Nos. illustrate other attempts to compensate for pressure fluctuations: No. 3,434,660, granted Mar. 25, 1969, to Fritz Brumme and Horst Boehme; No. 3,601,128, granted Aug. 24, 1971, to Salomon Hakim; No. 3,621,882, granted Nov. 23, 1971, to Harry P. Kupiec; No. 3,675,684, granted Jul. 11, 1972, to Jacques H. Mercier, Fernand Copine and Carlo Corbellini; No. 3,722,751, granted Mar. 27, 1973, to Natalie R. Bisciglia; No. 3,828,608, granted Aug. 13, 1974, to Katsuro Yamamoto; No. 4,013,221, granted Mar. 22, 1977, to Anton Eder; No. 4,206,908, granted Jun. 10, 1980, to Jacques H. Mercier; and No. 4,211,208, granted Jul. 8, 1980, to Frederick Lindner.

None of these patents disclose a suitable and economical pressure compensating means for use in efficient, safe and cost-effective water heaters.

Accordingly, there is a great and thus far unsatisfied demand for a water heater having an integrally-mounted and cost-effective pressure compensating means.

OBJECTS OF THE INVENTION

It is an object of this invention to provide a water heater having a pressure compensating means that overcomes the shortcomings associated with the prior art.

It is another object of the invention to provide a water heater having a pressure compensation means internally positioned for maintaining substantially constant pressure within the water heater storage tank.

It is a further object of the invention to provide a water heater having a pressure compensating means for equalizing pressure increases caused by water expansion and contraction resulting from temperature variations.

It is still another object of this invention to provide a lined water heater having pressure compensating means.

Another object of this invention is to provide a safe, inexpensive, and efficient lined water heater.

SUMMARY OF THE INVENTION

This invention provides a water heater having means compensating for pressure fluctuations within the water heater storage tank. A pressure compensating cushion within the water heater storage tank compensates for pressure fluctuations caused by the expansion and contraction of stored water as its temperature changes.

The water heater in accordance with this invention has a rigid outer shell with ports for water inlet and outlet as well as ports for other components and functions of standard water heaters combined with a liner in the form of a container mounted within the rigid outer shell. The container which forms the liner has fittings for water inlet and outlet as well as for the insertion of other standard water heater components. The container fittings are mounted to the outer shell ports and the container wall comprises a liner which substantially conforms to the interior surface of the outer shell.

The container in accordance with this invention is formed with an integral pressure compensating cushion that is preferably (but not necessarily) pre-charged with pressurized gas. Preferably it contains air at atmospheric pressure. The pressure compensating cushion contracts as pressure within the storage tank increases and expands when the pressure within the tank decreases, thereby compensating for pressure fluctuations and reducing the tendency to force hot water out from the storage tank or to draw unwanted cold water into the storage tank.

DETAILED DESCRIPTION OF THE INVENTION

Figure 1:
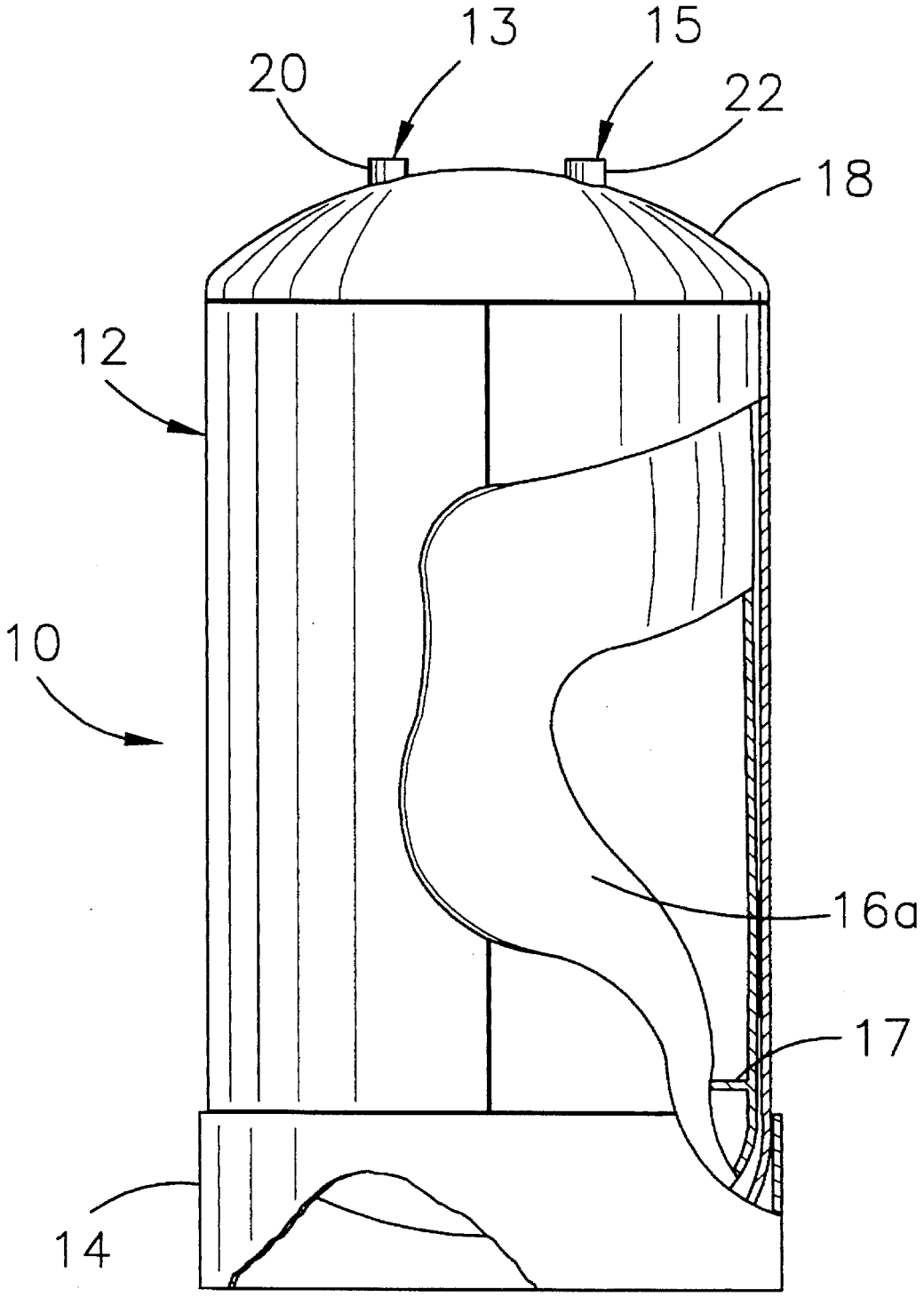
FIG. 1 is a side view, with a portion broken away and shown in section in order to reveal important details, of one form of water heater storage tank embodying features of this invention.

The following description is intended to refer to the specific embodiments of the invention illustrated in the drawings. This description is not intended to define or limit the scope of the invention, which is defined separately in the claims that follow.

Referring to FIG. 1, the numeral 10 designates a water heater storage tank which has an outer shell 12 with ports 13 and 15 for water inlet and outlet, respectively. Storage tank 10 has a base 14 upon which outer shell 12 is mounted. Storage tank 10 has a liner in the form of a container 16*a* positioned within outer shell 12 for storing water introduced through and removed from ports 13 and 15. Container 16*a* which forms the tank liner has a pressure compensating cushion 17 adapted to expand and contract to maintain substantially constant pressure within the liner.

Outer shell 12 has an upper cap 18 to which inlet fitting 20 and outlet fitting 22 are attached. Outer shell 12 has a cylindrical wall 24 as well as a bottom cap 26. Details of the construction of outer shell 12, as well as procedures for its manufacture, are disclosed in co-pending application Ser. No. 08/195,385.

Outer shell 12 may optionally have a two-piece construction whereby two capsule-type portions are deep drawn and welded at a single circumferential weld seam. Similarly, water inlet and outlet ports may be optionally located in the cylindrical wall 34, the bottom cap 26, or in any combination of the shell components.

It is important to note that an outer shell for a storage tank embodying this invention need not have a welded construction. For example, shell components are optionally provided with radial flanges that are bolted together, or the shell components can be mechanically fastened in any other known manner. Also, for storage tanks not intended to hold pressure, the outer shell need not have pressure-tight seams so long as the shell provides structural containment for the bag-like liner. Water heater storage tanks are, of course, required to hold water under pressure.

Figure 2:
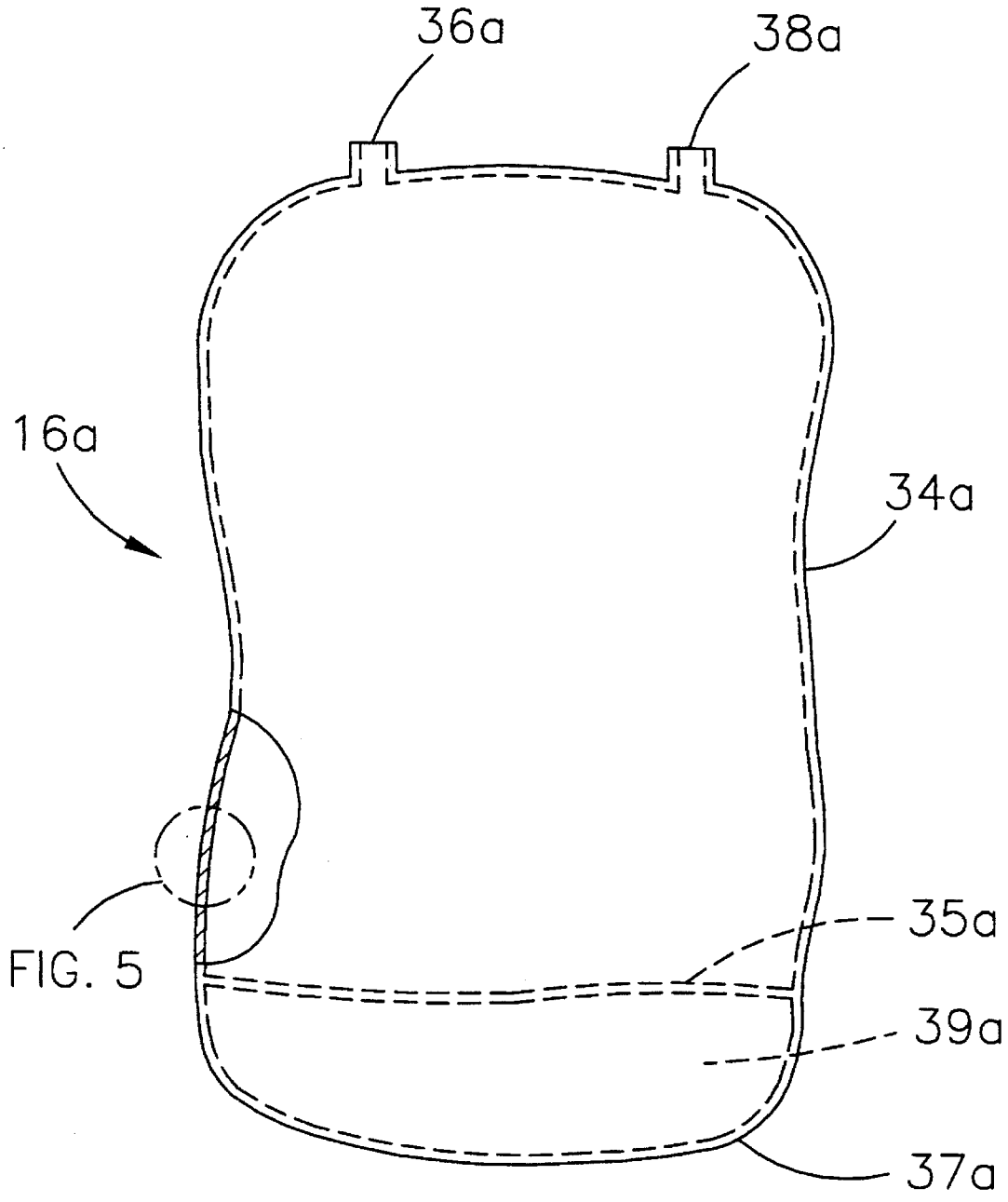
FIG. 2 is a side view of a container used as a liner component in a storage tank of the kind shown in FIG. 1, illustrated to show the basic components of the container.

FIG. 2 shows details of one form of container 16 adapted for use as a tank liner, selected to illustrate several preferred features of any embodiment of container according to this invention. Container 16*a* is an enclosed bag having a wall 34*a* upon which fittings 36*a* and 38*a* are attached. Fitting 36*a* is provided for water inlet and fitting 38*a* for water outlet. Fittings 36*a* and 38*a* are attached at holes in wall 34*a*, and are connected via a molding process, a plastics welding process, or any other known process. Wall 34*a* is preferably flexible and is optionally collapsible in response to pressure differentials between the container interior and exterior.

Container 16*a* has an interior wall 35*a*, shown in phantom in FIG. 2. Interior wall 35*a* cooperates with a bottom portion 37*a* of wall 34*a* to create a compressible volume 39*a*. Details of interior wall 35*a* will be described hereinafter with reference to FIG. 3*a*.

Container 16*a* is preferably formed by known extrusion processes or optionally by known blow-molding or injection-molding processes. However formed, container 16*a* preferably has a bag-like shape having openings only where fittings 36*a* and 38*a* and any other needed fittings are mounted. Wall 34*a* of container 16*a* preferably has a multi-layered construction described later in detail with reference to FIG. 5. Additional details of such a container are disclosed in co-pending application Ser. No. 08/195,386.

Figure 3A:
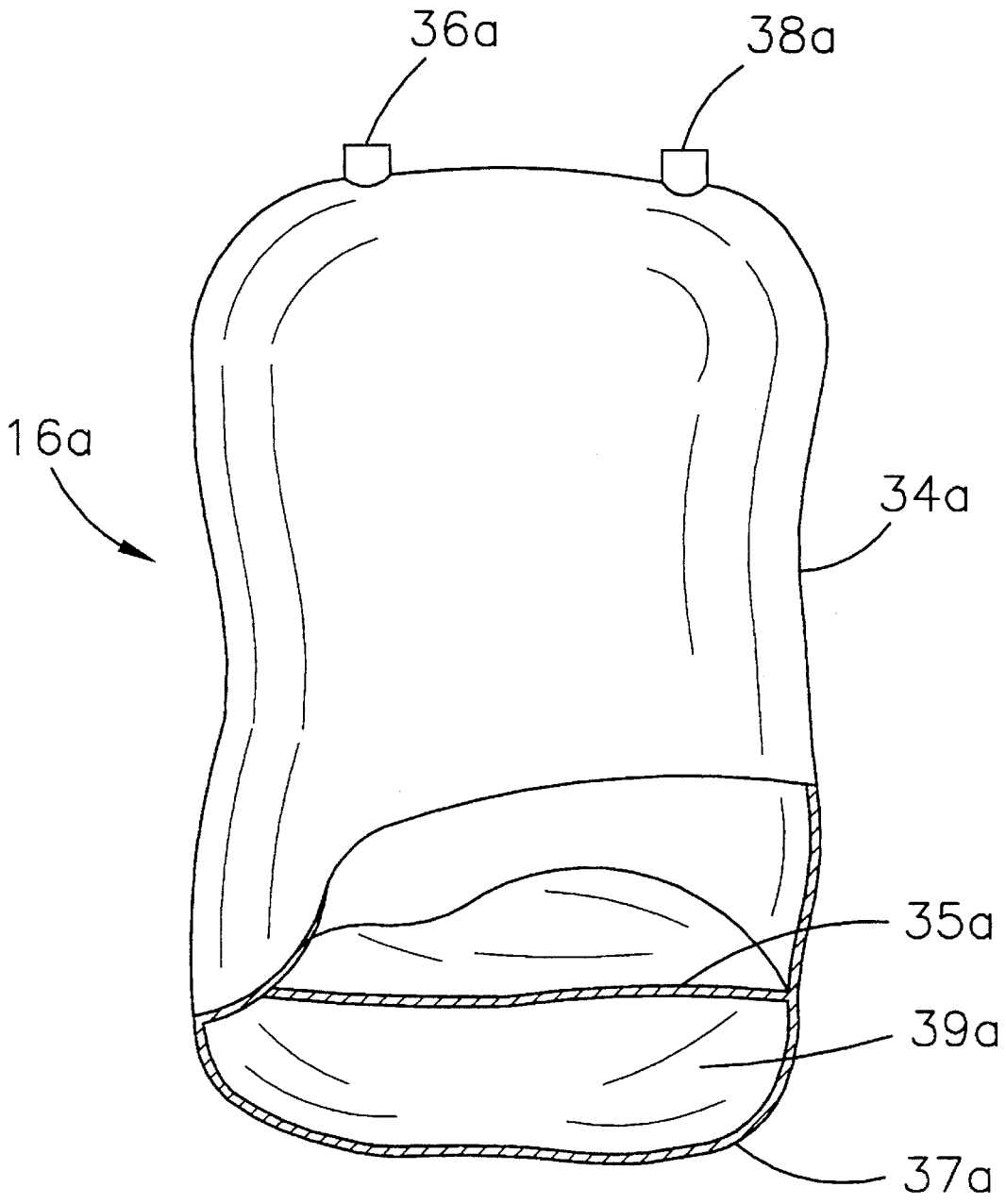
FIG. 3*a* is a perspective view of the container embodiment shown in FIG. 2, having a portion broken away and shown in section to reveal internal details of the container.

FIG. 3*a* shows details of container 16*a* shown in FIG. 2. Container 16*a* has an interior wall 35*a* near bottom portion 37*a* of wall 34*a*. Interior wall 35*a* and bottom portion 37*a* of wall 34*a* create compressible volume 39*a*. Interior wall 35*a* is integrally attached to wall 34*a* in any known manner, including but not limited to known blow molding, injection molding, heat sealing or other processes.

Interior wall 35*a* is flexible, fluid tight, and capable of deforming in response to pressure changes within the upper portion of container 16*a*. For example, when pressure in the upper portion of container 16*a* increases, interior wall 35*a* is pushed downward to increase the volume of the upper portion of container 16*a* and simultaneously compress trapped volume 39*a*. Conversely, interior wall 35*a* will rise in response to decreased pressure in the upper portion of container 16*a* thereby decreasing the volume of the upper portion and increasing trapped volume 39*a*.

Figure 3B:
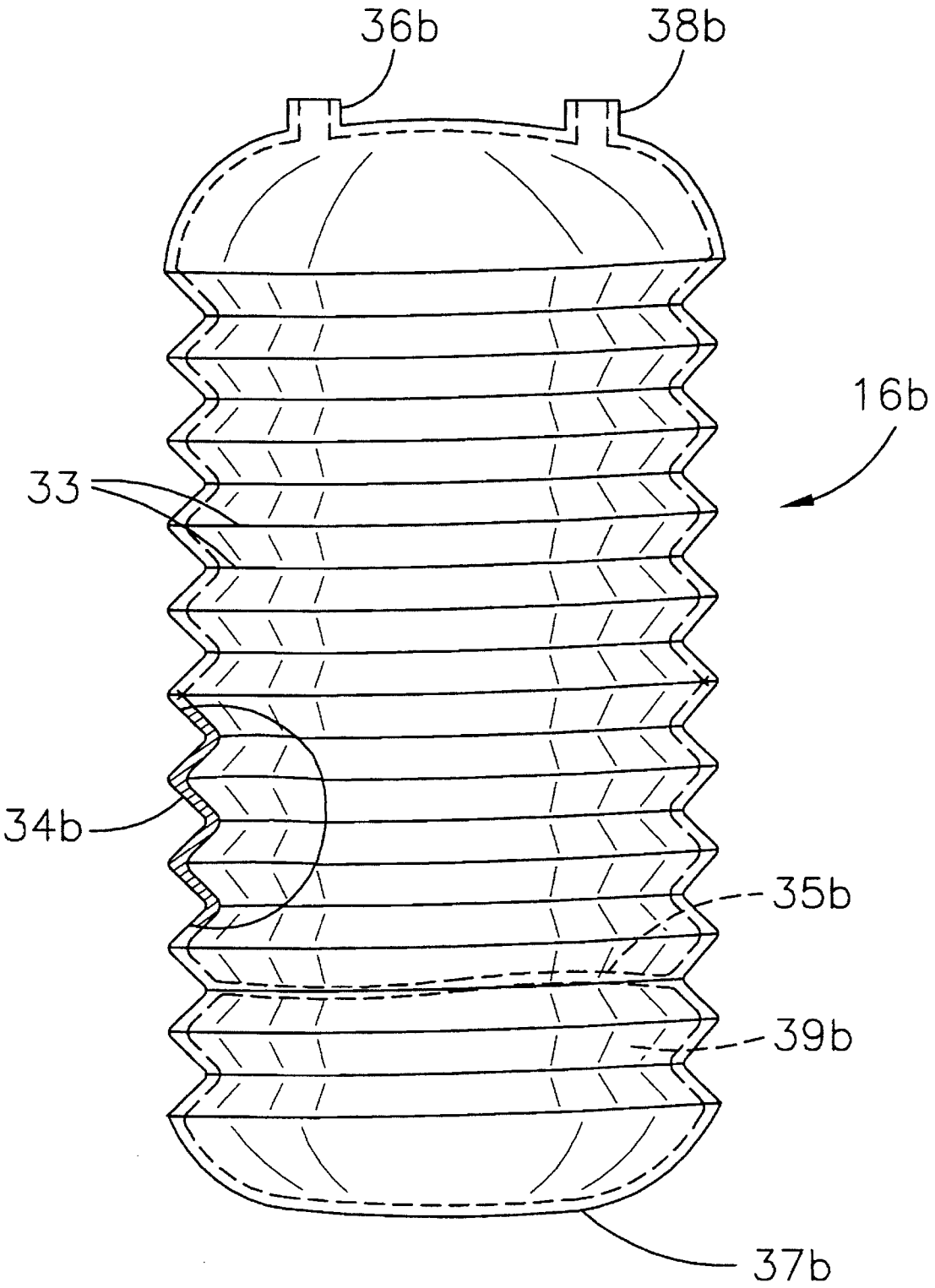
FIG. 3*b* is a side view of another container used as a liner component in a storage tank of the kind shown in FIG. 1.

FIG. 3*b* shows details of another container embodiment 16*b* adapted for use as a liner for storage tank 10 (FIG. 1 ). Like container 16*a* (FIGS. 2 and 3*a*), container 16*b* has a wall 34*b* to which fittings 36*b* and 38*b* are attached for water inlet and outlet. Container 16*b*, like container 16*a*, has an internal wall 35*b* which cooperates with bottom portion 37*b* of wall 34*b* to form compressible volume 39*b*.

Unlike container 16*a*, container 16*b* is provided with circumferential pleats defined by fold lines 33 formed in wall 34*b*. Fold lines 33 permit the vertical collapse of wall 34*b* to assist in equalization of the pressure within container 16*b* and to assist in assembly of storage tank 10. Specifically, fold lines 33 permit accordion-like expansion and contraction of container 16*b*. For details regarding a new method of assembling storage tank 10, utilizing a container having circumferential pleats, see co-pending application Ser. No. 08/195,385.

Fold lines 33 and resulting pleats are formed in wall 34*b* via known injection molding, blow molding, or any combination of these or other known processes. Fold lines 33 are provided over the entire cylindrical portion of wall 34*b* or over a specific portion of wall 34*b*. Fold lines 33 are optionally provided in the area of container 16*b* below internal wall 35*b* and adjacent compressible volume 39*b*. While fold lines 33 are shown in the preferred embodiment of container 16*b* shown in FIG. 3*b*, it is apparent that any known wall structure may be used so long as it provides the collapsible feature of container 16*b*.

Figure 3C:
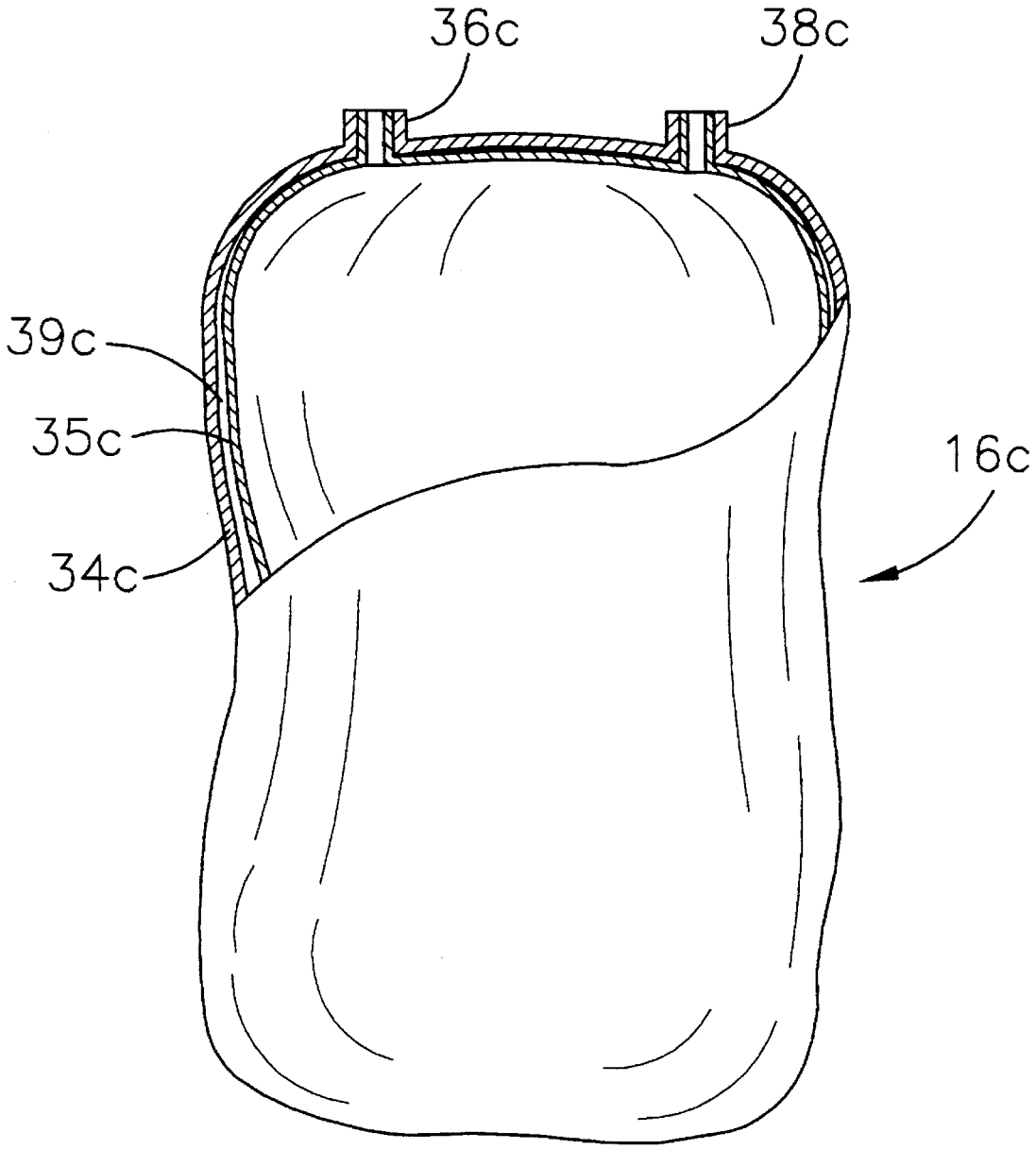
FIG. 3*c* is a side view of another embodiment of a container used as a liner component in a storage tank of the kind shown in FIG. 1, having a portion broken away and shown in section to reveal features of the container.

FIG. 3*c* shows details of yet another preferred form of container 16*a* shown in FIG. 1, generally designated container 16*c*. Container 16*c* has a wall 34*c* similar to that of wall 34*a* of container 16*a*. Wall 34*c* of container 16*c* also has fittings 36*c* and 38*c* for the inlet and outlet of water, respectively. Container 16*c* differs from container 16*a* in that it has an internal bladder wall 35*c* which generally conforms to wall 34*c*, but creates a compressible volume 39*c* between internal bladder wall 35*c* and wall 34*c*. Internal bladder wall 35*c* extends into fittings 36*c* and 38*c*, forming a pressure seal between walls 34*c* and 35*c*. Volume 39*c* acts in a manner similar to that of volume 39*a* in container 16*a* to compensate for pressure fluctuations within internal bladder wall 35*c*. Specifically, a pressure increase within internal bladder wall 35*c* collapses volume 39*c*, thereby increasing the volume within internal bladder wall 35*c* and reducing the pressure of water contained therein. Conversely, decreased pressure within internal bladder wall 35*c* causes expansion of volume 39*c* and reduction of the internal capacity of container 16*c* to equalize the pressure fluctuation.

It will be apparent that, although internal walls 35*a*, 35*b* and 35*c* of containers 16*a*, 16*b* and 16*c* are illustrated with specific configurations, pressure compensating means according to this invention can be provided in many different shapes or configurations. For example, the pressure compensating cushion can be located to accommodate components inserted into the interior of the storage tank such as those components used in standard electric and gas-fired water heaters as described hereinafter. The pressure compensating means can also be formed from numerous cushions of various sizes and shapes spaced throughout the inner surface of the container wall.

The shape and configuration of the container and the pressure compensation means therein can easily be modified to accommodate the combustion gas flue of a gas-fired water heater. Furthermore, the fittings provided on the container can be positioned according to the manufacturer's preference, and can be located at the top, bottom, sides or any combination of container surfaces. Similarly, the container can be provided with any number of fittings to accommodate the components required for standard electric and gas-fired water heaters.

Figure 4A:
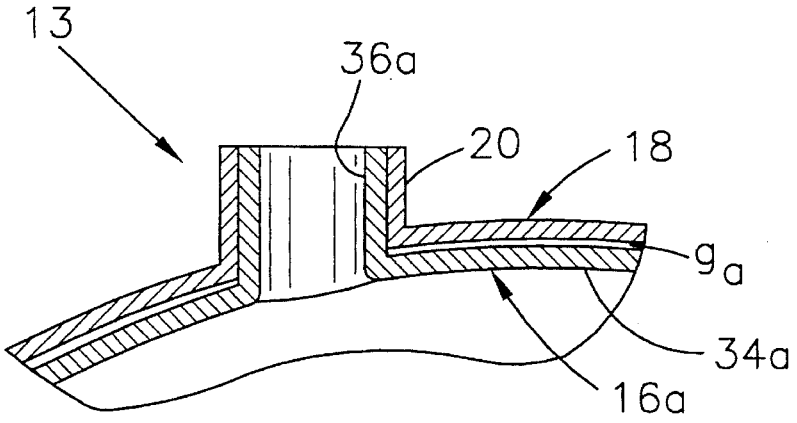
FIG. 4*a* is a cross-sectional side view of a port on the water heater tank shown in FIG. 1 with the container shown in FIG. 3*a*.

FIG. 4*a* shows details of water inlet port 13 located in upper cap 18 of outer shell 12 with container 16*a* forming the shell liner illustrated in FIG. 3*a*. Fitting 36*a* in wall 34*a* of container 16*a* is located within fitting 20 in upper cap 18. Water is introduced through inlet port 13 and fittings 20 and 36*a* and enters the interior of container 16*a* which forms the shell liner. The water does not, however, travel into a gap $g_a$ that may exist between wall 34*a* of container 16*a* and outer shell 12.

Fitting 36*a* in wall 34*a* of liner formed from container 16*a* is optionally provided with female pipe threads (not shown) for engagement with pipe fittings. However structured, water is prevented from migrating between fittings 20 and 36*a* and into gap $g_a$. The ports should also provide dielectric isolation between the pipe fittings mounted at the ports and the outer shell of the storage tank, thereby preventing the exposure of stored water to dissimilar metals and the accelerated corrosion caused thereby. This same structure applies to container 16*b* (FIG. 3*b*) with fitting 36*b* in wall 34*b* mounted within fitting 20 in upper cap 18.

Figure 4B:
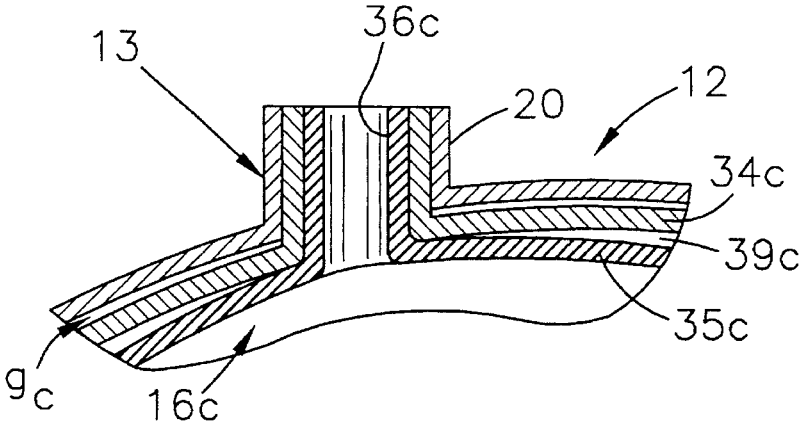
FIG. 4*b* is a cross-sectional side view of a port on the water heater tank shown in FIG. 1 with the container shown in FIG. 3*c*.

FIG. 4*b* shows details of water inlet port 13 located in upper cap 18 of outer shell 12 with container 16*c* provided as the shell liner illustrated in FIG. 3*c*. Fitting 36*c* in wall 34*c* of liner-forming container 16*c* is located within fitting 20 in upper cap 18. FIG. 4*b* illustrates that a gap $g_c$ exists between outer shell 12 and wall 34*c* of the liner formed from container 16*c*. Also, as illustrated in FIG. 3*c*, volume 39*c* is present between inner bladder wall 35*c* and wall 34*c* of container 16*c*. It is important that a fluid seal exists between fitting 20 of port 13 in outer shell 12 and wall 34*c* of liner-forming container 16*c*. It is also important that a fluid seal exists between wall 34*c* and internal bladder wall 35*c* of liner-forming container 16*c*. A fluid seal between fitting 20 and wall 34*c* ensures that water or other materials will not migrate into gap $g_c$. The fluid seal between internal bladder wall 35*c* and wall 34*c* maintains pressure within volume 39*c*.

Figure 5:
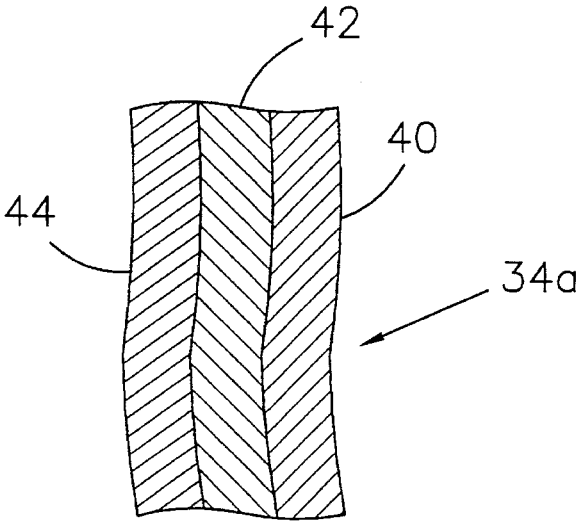
FIG. 5 is a cross-sectional side view of a portion of the container shown in FIG. 3*a*.

FIG. 5 shows details of a cross section of wall 34*a* of container 16*a*. Wall 34*a* preferably has three or more layers, the embodiment shown in FIG. 5 having three such layers 40, 42, and 44. Layer 40, which faces the interior of container 16*a*, is formed of a material appropriate for contact with potable water, for example. The material of layer 40 is optionally capable of providing chemical resistance if the storage tank is used for containment of materials other than water. Layer 40 of container 16*a* adapted to store water is preferably formed from polyethylene or polypropylene. Layer 42 provides a vapor barrier to retain vapors within storage tank 10. Layer 42 is preferably formed from a metallic layer such as aluminum. Layer 44, the outside layer, is preferably composed of an insulating material for providing a barrier between layer 42 and the interior of outer shell 12. Polyethylene or polypropylene are preferably used to form layer 44.

A container formed with the multi-layer wall 34*a* shown in FIG. 5 is preferably formed by known co-extrusion processes, but other known processes can also be used. For example, container 16*a* is optionally formed from laminated sheet material heat sealed or plastics welded to form a bag-like shape, or container 16*a* can be formed by known blow-molding processes.

The wall of the container and the pressure compensating cushion can optionally have any number of layers. For example, additional layers can be added for specific functions or simply to dispose of recycled plastics. The wall of the container may be of any configuration so long as it provides a barrier against vapors, sufficient strength to withstand the manufacturing processes and continued use, and resistance against corrosion of the outer shell. Additionally, when the storage tank is integral with an electric or gas-fired water heater as described later with reference to FIGS. 6*a* and 6*b*, the container must be capable of withstanding continuous elevated temperatures.

The structure of wall 34*a* of container 16*a* also applies to walls 34*b* and 35*b* of container 16*b* and walls 34*c* and 35*c* of container 16*c*.

The storage tank embodiment described herein can be modified for a great number of uses and applications. For example, the storage tank can be a water storage tank for a water heating system. Specifically, the storage tank can be modified to accommodate the additional components required for operation and control of electric or gas-fired water heaters.

Figure 6B:
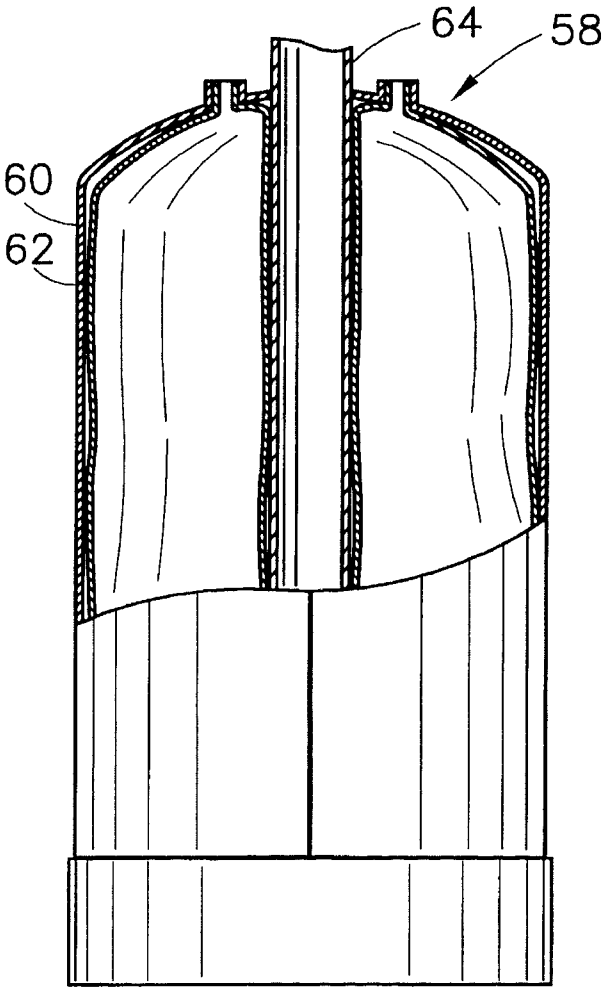
FIG. 6*b* is a side view of a gas-fired water heater embodying features of this invention.
Figure 6A:
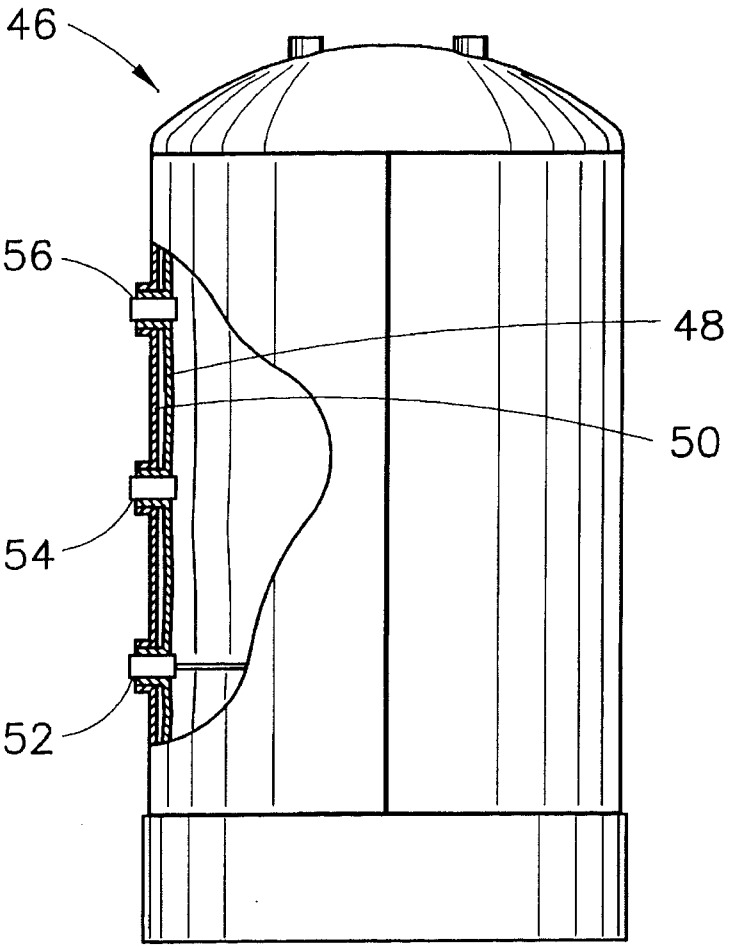
FIG. 6*a* is a side view of an electric water heater embodying features of this invention.

In the case of the lined electric water heater 46 illustrated in FIG. 6*a*, outer shell 50 and liner 48 are adapted to accommodate additional ports for a thermostat 56, a pressure relief valve 54, and for one or more heating elements 52. These additional ports are preferably located in the side wall of outer shell 50 as shown, but are optionally positioned in the top or bottom caps of the tank. The ports have the same structure as port 13 shown in FIG. 4.

A lined gas-fired water heater 58 is shown in FIG. 6*b*. Lined gas-fired water heater 58, of course, has additional ports for a thermostat and a pressure relief valve and possibly others (not shown). More significantly, a shell component 60 and a liner component 62 of gas-fired water heater 58 accommodates a flue 64 running upwardly through the storage tank, preferably near the tank center. Liner 62 has an opening through and along its central axis, thereby providing liner 62 with a toroidal, or doughnut-like, shape. Flue 64 is optionally positioned near the wall of shell 60.

It is apparent that liner 62 is easily modified to accommodate a flue having any position or shape. Liner 62 must, however, be formed from materials capable of withstanding elevated temperatures proximal to the flue. Accordingly, heat resistant materials must be used to form liner 62, at least the portion of the liner 62 adjacent flue 64.

The method of producing a storage tank according to this invention, as well as water heaters 46 and 58 shown in FIGS. 6*a* and 6*b*, is disclosed in co-pending application Ser. No. 08/195,385. As noted previously, the container which forms the liner is optionally provided with a flexible wall or even circumferential pleats to permit the container wall to collapse. Such a feature assists in the manufacturing process whereby vacuum applied to the container is used to collapse and draw the container bottom upwardly so that the outer shell can be completed without damaging the liner.

In any embodiment a water heater storage tank according to this invention surprisingly provides significant benefits. The fact that the cushion contains a gas, which is much more easily expandable and compressible than water, is important. The relatively small volumetric expansion and contraction of water, even when subjected to larger temperature variations, is easily compensated for by relatively small pressure variations in an equal volume of the gas.

Furthermore, compensation for volumetric and pressure fluctuations is provided notwithstanding transfer of heat to or from the gas. For example, as the temperature of water within the storage tank rises and causes the water to expand, heat is transferred to the gas in the pressure compensating cushion urging it to expand as well. However, the force exerted by the expanded water is greater than that of the expanded gas, and the pressure compensating cushion is compressed to maintain substantially constant water pressure. Accordingly, this phenomenon, caused by the irresistible force of expanding water, permits pressure compensation despite the effect of heat transfer within the container. Because of this phenomenon, the medium within the pressure compensating cushion can be any medium (even a solid) that is more easily compressible than water, even if that medium has a coefficient of thermal expansion greater than that of water.

This invention provides a reliable and inexpensive water heater that can be produced efficiently and rapidly, using automated production systems. The container which forms the tank lining provides durable and reliable protection against corrosion of the outer shell. The pressure compensation feature of the liner maintains substantially constant pressure within the water heater storage tank, thereby improving water heater efficiency and safety.

Although this invention has been described with reference to specific forms selected for illustration in the drawings, and with reference to many variations thereof, it will be appreciated that many other variations may be made without departing from the important feature of providing an inexpensive and reliable lined water heater storage tank with a pressure compensation means. All variations to the embodiments explicitly described herein, including the substitution of equivalent elements for those specifically shown and described, are within the spirit and scope of the invention as defined in the appended claims.

What is claimed is:

1. A lined water heater storage tank comprising:

an outer shell having ports connected to said outer shell for water flow into and out from said water heater storage tank; and a liner within said outer shell having a water tight outer wall and fittings connected to said outer wall for water flow into and out from said liner, said fittings on said outer wall of said liner being mounted in said ports on said outer shell, said liner having a fluid tight pressure compensating cushion defined by an interior wall mounted to said outer wall of said liner and forming a pressure-tight seal with said outer wall at said fittings on said outer wall of said liner, said pressure compensating cushion containing a fluid having capacity to expand and contract to compensate for water pressure fluctuations within said water heater storage tank, said fluid in said pressure compensating cushion being more easily compressible than water.

2. The water heater storage tank described in claim 1, wherein said outer wall of said liner has a multi-layered construction, at least one layer providing a vapor barrier and at least one layer being suitable for contact with water.

3. The water heater storage tank described in claim 1, wherein said pressure compensating cushion is a flexible bladder integrally formed in said outer wall of said liner.

4. The water heater storage tank defined in claim 1, wherein said water heater storage tank is a part of an electric water heater and said outer shell and said liner further comprise a port for a heating element.

5. The water heater storage tank defined in claim 1, wherein said water heater storage tank is a part of a water heater having a flue mounted to said outer shell, said liner being positioned for heat transfer from contents of said flue to water in said liner.

6. A water heater comprising:

an outer shell having ports connected to said outer shell for water flow into and out from said water heater;

a liner within said outer shell having a water tight outer wall and fittings connected to said outer wall for water flow into and out from said liner, said fittings on said outer wall of said liner being mounted in said ports on said outer shell, said liner having a fluid tight pressure compensating cushion defined by an interior wall mounted to said outer wall of said liner and forming a pressure-tight seal with said outer wall at said fittings on said outer wall of said liner, said pressure compensating cushion containing a fluid having capacity to expand and contract to compensate for water pressure fluctuations within said water heater, said fluid in said pressure compensating cushion being more easily compressible than water; and a heat source positioned to heat water contained in said liner.

7. The water heater defined in claim 6, wherein said heat source is an electric heating element.

8. The water heater defined in claim 6, wherein said heat source is a combustible fuel burner.

* * * * *